US012421721B2

(12) United States Patent
Burmeister et al.

(10) Patent No.: US 12,421,721 B2
(45) Date of Patent: Sep. 23, 2025

(54) CONSOLE FOR RETRACTABLE ROOFS AND FACADES

(71) Applicant: Delta-X GmbH Ingenieurgesellschaft, Stuttgart (DE)

(72) Inventors: Albrecht Burmeister, Weissach im Tal (DE); Lutz Eitel, Esslingen (DE); Michael Keefer, Weinstadt (DE)

(73) Assignee: Delta-X GmbH Ingenieurgesellschaft, Stuttgart (DE)

( * ) Notice: Subject to any disclaimer, the term of this patent is extended or adjusted under 35 U.S.C. 154(b) by 0 days.

(21) Appl. No.: 18/683,886

(22) PCT Filed: Aug. 12, 2022

(86) PCT No.: PCT/EP2022/072703
§ 371 (c)(1),
(2) Date: Feb. 15, 2024

(87) PCT Pub. No.: WO2023/020971
PCT Pub. Date: Feb. 23, 2023

(65) Prior Publication Data

US 2024/0368882 A1 Nov. 7, 2024

(30) Foreign Application Priority Data

Aug. 16, 2021 (DE) ..... 10 2021 121 244.8

(51) Int. Cl.
*E04B 7/16* (2006.01)

(52) U.S. Cl.
CPC ..... *E04B 7/166* (2013.01)

(58) Field of Classification Search
CPC ..... E04B 7/16; E04B 7/166; E04H 3/165
See application file for complete search history.

(56) References Cited

U.S. PATENT DOCUMENTS 5,351,449 A * 10/1994 Allen ..... E04H 3/165 52/6
5,546,972 A * 8/1996 Wardell ..... B60J 7/062 296/105
5,896,708 A * 4/1999 Doi ..... E04B 7/166 52/66
6,367,206 B1 * 4/2002 Silberman ..... E04B 7/166 52/6
2004/0123380 A1 * 7/2004 Shebek ..... E04H 4/141 4/502
2020/0181900 A1 * 6/2020 Fedor ..... E04B 1/343

FOREIGN PATENT DOCUMENTS

AT 405546 B 9/1999
CN 109098337 A 12/2018
FR 2862686 A1 * 5/2005 ..... E04B 1/34368
WO 2023020971 A1 2/2023

OTHER PUBLICATIONS

Translated German Examination Report, Application No. 102021121244.8, dated Jul. 7, 2022, 1-16.
Translated International Search Report, Application No. PCT/EP2022/072703, prepared Oct. 19, 2022, mailed Nov. 8, 2022, pp. 1-5.

* cited by examiner

*Primary Examiner* — Christine T Cajilig
(74) *Attorney, Agent, or Firm* — BOND, SCHOENECK & KING, PLLC; George R. McGuire

(57) ABSTRACT

The invention relates to a console with the aid of which large roofs and facade elements can be horizontally or vertically retracted.

10 Claims, 9 Drawing Sheets

View 1 - 1

View 1 - 1

CONSOLE FOR RETRACTABLE ROOFS AND FACADES

CROSS-REFERENCE TO RELATED APPLICATION

The present application is the United States National Stage Application, filed under 37 U.S.C. 371, of International Patent Application No. PCT/EP2022/072703, filed on Aug. 12, 2022, which claims priority to German Patent Application 10 2021 121 244.8, filed Aug. 16, 2021, the entire contents of each of which is hereby incorporated by reference.

BACKGROUND OF THE INVENTION

The invention relates to a console for retractable roofs and movable facades.

In many leisure facilities, such as swimming pools, so-called fun pools, soccer arenas, indoor tennis courts or cruise ships, people want to pursue leisure and sports activities in the open air wherever possible. If the weather is bad, these leisure activities should be carried out in pleasant outdoor conditions and protected from the weather. This is possible if the roof and/or parts of the facade of the thermal baths, bathing facilities, tennis courts or soccer arenas are retractable. The roof and/or the facade can then be "pushed aside" if necessary, allowing sunlight and fresh air to enter the interior of the building. If the weather turns bad or the temperatures are too low, the roof and/or facade is moved back over or in front of the building.

However, a retractable roof or facade can also be used to quickly and safely extract smoke from the space below in the event of a fire. It can also be advantageous in industrial facilities if the roof or parts of the facade are retractable, for example to lift large machines or workpieces into a hall.

Atriums and inner courtyards are also typical applications for retractable roofs, also against the background of being able to realize energy savings, more favorable air conditioning, etc. for the buildings surrounding the atrium/courtyard through such retractable roofs or facades.

Considerable wind forces, rain or snow loads and/or gravitational forces act on these retractable roofs or facades (parts), which must be safely transferred to the load-bearing structure of the building in every position and under all conceivable circumstances.

In addition, increasingly higher demands are being placed on the aesthetics and design of these leisure facilities.

US 2020/0181909 A1 discloses a console for retractable roofs of the same type.

SUMMARY OF THE INVENTION

In the following, for the sake of linguistic simplification, only roofs or a retractable component are usually referred to; roofs and facades or parts thereof are always meant.

The object of the invention is to provide a console for retractable roofs and facades which fulfills the functional and safety requirements with regard to precise and safe guidance of the roofs and facade parts to be retractable.

Finally, tension between the console and a linear guide should be minimized in order to extend the service life of the linear guide or reduce its load.

This object is solved according to the invention by a console for retractable roofs and facades, comprising a load introduction plate and a mechanical interface, wherein the load introduction plate has a base surface and at least one side surface, wherein the mechanical interface comprises a first bearing plate, at least one rib and a second bearing plate arranged on the at least one rib, wherein a first elastomeric bearing, in particular a first EPDM bearing, is deposited between the base surface of the load introduction plate and the first bearing plate, and wherein a second elastomeric bearing, in particular a second EPDM bearing, is deposited between the second bearing plate and the side surface of the load introduction plate.

According to the invention, the loads to be transmitted in the vertical direction between the mechanical interface and the load introduction plate are thus intended to be transmitted via a first elastomer or EPDM bearing. The loads to be transmitted in the horizontal direction are transmitted by the second elastomer or EPDM bearing.

One advantage of the design according to the invention with two elastomer or EPDM bearings is that the two elastomer or EPDM bearings are largely independent of each other in terms of design, material selection, dimensioning and shape. This allows the first elastomer or EPDM layer to be dimensioned substantially depending on the expected vertical loads. The second elastomer or EPDM bearing only has to transmit the horizontal loads and can therefore generally be smaller and "softer". This ensures that the loads are transmitted safely.

The "softer" design, especially of the second EPDM layer, minimizes the stresses that occur between the mechanical interface and the load introduction plate during operation.

Such stresses are caused, for example, by different temperature-related expansions of the roof/facade and the bearing structures (buildings).

Especially for large roofs with a span of over 30 meters (30 m), this can lead to considerable internal forces within the consoles. These internal forces also load the bearing of a linear guide on which the consoles are guided.

The arrangement of two elastomer or EPDM bearings according to the invention can significantly reduce these tensions and thus also the forces acting on the linear guide. This results in an increased service life of the linear guide or the linear guide can be dimensioned smaller without compromising on service life and safety. Slimmer, i.e. more aesthetically pleasing, solutions can be realized and the costs for the console and linear guide are reduced.

In addition, linear guides that are available on the market can also be used for very large roofs; custom-made products are then not required.

The elastomer or EPDM bearings substantially each have a plate made of EPDM or another suitable material. The composition of the EPDM in terms of load-bearing capacity and elasticity can be selected from a plurality of EPDM materials available on the market. The EPDMs available on the market differ in terms of hardness, compressive strength, ageing resistance and elongation.

It is also possible to integrate reinforcements into the elastomer or EPDM. This increases the compressive strength and reduces the tendency to flow under high compressive loads.

In an advantageous embodiment, the load introduction plate comprises two side surfaces, wherein an angle $\beta$ between the normal vectors of the surface of the connecting plate and one of the side surfaces is between 60° and 120°.

If the angle $\beta$ is 90°, then the first elastomer or EPDM bearing and the second elastomer or EPDM bearing are "linearly" independent. In other words, the first elastomer or EPDM bearing transmits predominantly vertical loads from the mechanical interface to the load introduction plate, while the second elastomer or EPDM bearing transmits predominantly horizontal loads between the mechanical interface and the load introduction plate.

If the (normal) angle β between the base surface and the at least one side surface is less than 90°, the second elastomer or EPDM bearing can also take on part of the vertical loads.

If the angle β is greater than 90°, a form closure can be produced between the mechanical interface and the load introduction plate with the help of the second elastomer or EPDM bearing. This ensures that even if one or both elastomer or EPDM bearings fail, the console is securely connected to the linear guide and thus to the structure of the building. This prevents the roof or facade from being torn off the bearing structure in the event of a storm and a defective elastomer or EPDM bearing, for example.

A further possibility of a form closure between the mechanical interface and the load introduction plate, or the linear guide, can be realized according to the invention in that the at least one rib engages positively around the load introduction plate and its side surface, or its side surfaces.

In a further advantageous embodiment, the mechanical interface comprises two or more ribs, wherein the first bearing plate and/or the second bearing plate is connected to the ribs. The connection is usually a welding connection, as the ribs and the bearing plates are usually produced from steel and can be welded together in a highly resilient and cost-effective manner.

In a further advantageous embodiment of the invention, each rib comprises two legs, wherein at least one holding part is detachably fastened to the legs and engages around one of the side surfaces of the load introduction plate. The holding parts and the ribs are usually detachably connected to one another via a screw connection.

If one of the two elastomer or EPDM bearings is to be replaced, the form closure between the mechanical interface and the load introduction plate can be removed when the holding part(s) is/are detached from the ribs.

In order to be able to connect the mechanical interface to a retractable roof or a retractable facade, in a preferred embodiment it has one or more flange plates. These flange plates can be connected to carriers of the roof or the retractable facade by screws, for example, such that the mechanical interface can be produced independently of the roof or the facade element. The flange plates can be used to connect the mechanical interface to various roofs and facade elements without the need for any design changes to the console according to the invention.

In a further advantageous embodiment, the load introduction plate is part of a linear guide, wherein the linear guide comprises a guide rail. The guide rail is directly or indirectly connected to a bearing structure of a building.

The load introduction plate is preferably arranged on one or more carriages or integrated into them. The carriage(s) are guided on the guide rail.

In a preferred further embodiment, it is possible for the carriage or carriages and the guide rail to be a linear or roller guide available on the market. These roller guides are generally intended for use in machines or other installations. They can also be used to move roofs and/or facade elements with the aid of the console according to the invention. Because these roller guides are mass-produced industrial products, they are available in very high quality. In addition, the costs are relatively low compared to a custom-made product.

To reduce the load on the carriages, but also the local load on the guide rail, it is advantageous in many cases to connect the load introduction plate or console to several carriages. This reduces the load on the individual carriages. However, the local load on the guide rail is also reduced because the forces to be transmitted are introduced into the guide rail at several locations (according to the distance between the carriages). This also means that relatively slim guide rails and carriages can be used. This reduces costs and makes the console according to the invention aesthetically pleasing, as it can be designed to be light and filigree.

Of course, the use of several carriages also ensures that safety against failure is guaranteed. If a carriage or a roller bearing of one of the carriages fails, the other carriage(s) can take over the load, at least until the roof or facade element is closed. This ensures the operational safety of the movable roof or facade element.

The guide rails available on the market generally comprise a base, which is the area to which the guide rail is bolted to a machine foundation, for example, and a bearing area.

This bearing area is part of the roller or plain bearing between the carriage and the guide rail. The bearing area of linear guides with roller bearings is usually designed with a "waisted" shape. It has the shape of an "X" in cross-section, so to speak. The forces between the carriage and the guide rail are transmitted via the guide surfaces of the bearing area. As such guide rails or linear guides are available on the market, they are known to the person skilled in art and a detailed description is not provided.

Preferably, a first distance S1 between the bearing area of the guide rail and the contact surface between the first bearing plate and the first elastomer or EPDM bearing is approximately the same as a second distance S2 between the bearing area and the contact surface between the second bearing plate and the second elastomer or EPDM bearing. FIG. 7 shows the distances S1 and S2.

This means that the bearing area of the guide rail is approximately in the center of an imaginary circle. The first bearing plate and the second bearing plate are tangents on this imaginary circle. The normal vectors of the first bearing plate and the second bearing plate therefore extend in a radial direction, i.e. they are directed towards the bearing area of the guide rail. As a result, the vertical loads are transmitted directly from the first bearing plate to the guide rail over the shortest possible distance. The tilting moments acting on the guide rail or the roller bearings between the guide rail and carriage are minimized.

The same applies to the transmission of horizontal loads from the second bearing plate to the guide rail. As a result, tilting of the carriage(s) relative to the guide rail is avoided. This reduces the stress on the linear guide. For example, in a roller bearing with cylindrical rollers as rolling bodies, the rollers are loaded evenly over their totality; local overloads of individual roller bodies do not occur, which has a positive effect on the smooth running and service life of the linear guide.

In terms of design, the first distance S1 and the second distance S2 between the first bearing plate and the guide portion or the second bearing plate S2 and the guide portion can be adjusted using supports (metal plates of suitable thickness) if necessary. These supports can, for example, be welded to the load introduction plate or bolted to it. The difference (S1−S2) between the first distance (S1) and the second distance (S2) is preferably less than 30% ($|S1-S2|<0.3\times S1$).

The guide rail can be fastened directly or indirectly to a bearing structure of a building. This can be done using clamping elements, for example.

If the guide rail is not rigid enough, particularly for the receptacle of lateral loads, the guide rail can be arranged on a carrier rail and, in particular, screwed to it. Ideally, a groove is provided in the carrier rail into which the base of the guide rail is inserted. This results in a form closure between the carrier rail and the guide rail, especially in the horizontal direction. This significantly increases the bending stiffness of the guide rail. This means that guide rails available on the market can be "upgraded" for the receptacle of large lateral forces. This also significantly expands the range of applications for linear guides on the market without compromising on the safety and service life of the linear guide.

Further advantages and advantageous embodiments of the invention can be seen in the following drawing, its description and the claims.

BRIEF DESCRIPTION OF THE DRAWING FIGURES

DETAILED DESCRIPTION

Figure 1:
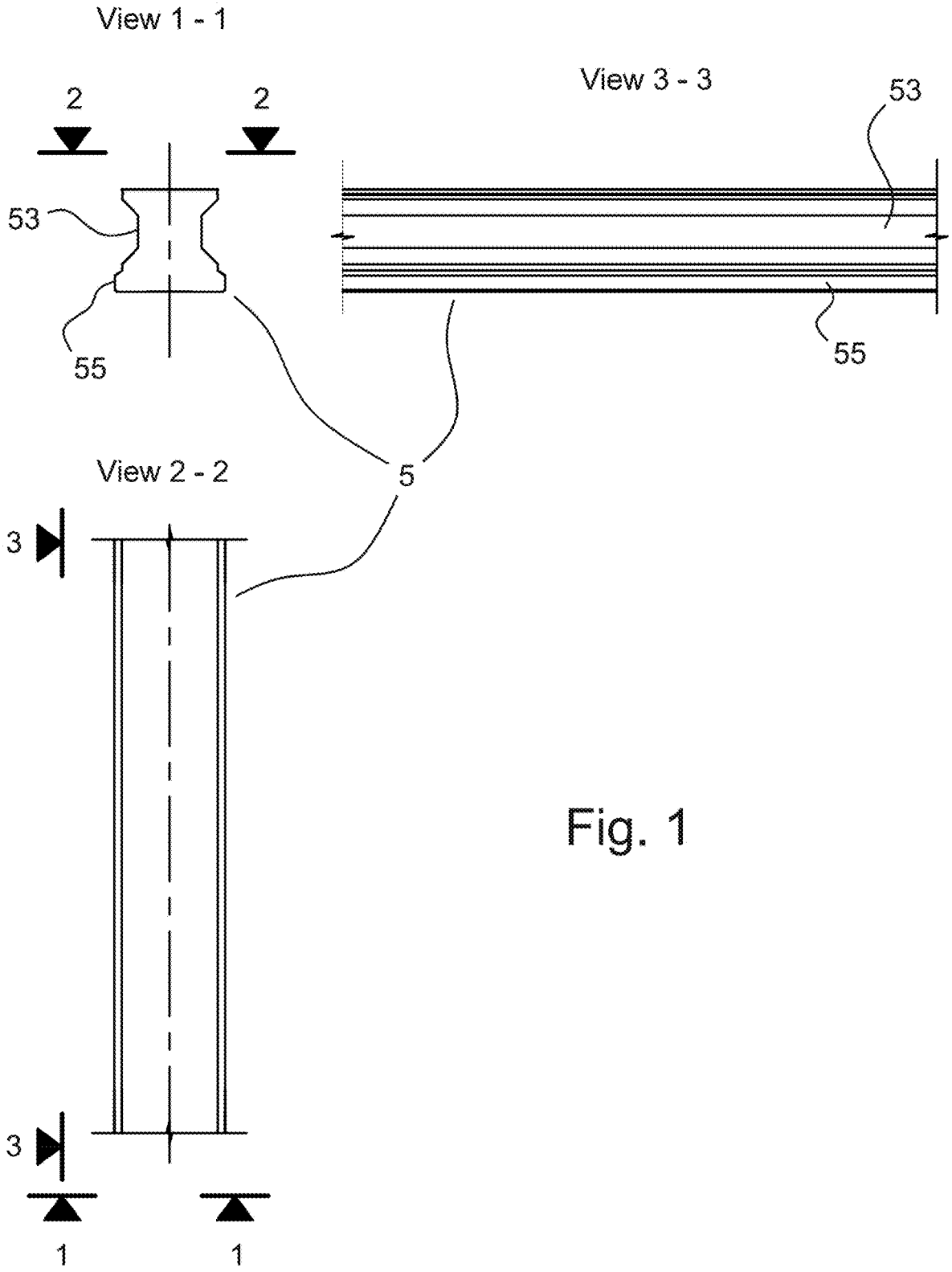
FIG. 1 shows a guide rail.

The same reference numerals are used in all figures.

FIG. 1 shows a guide rail 5 in various views. The area of the guide rail 5 that is "waisted" in cross-section is the so-called bearing area 53. The base 55 serves to connect the guide rail 5 to a bearing structure 13 (see FIG. 7).

Figure 2:
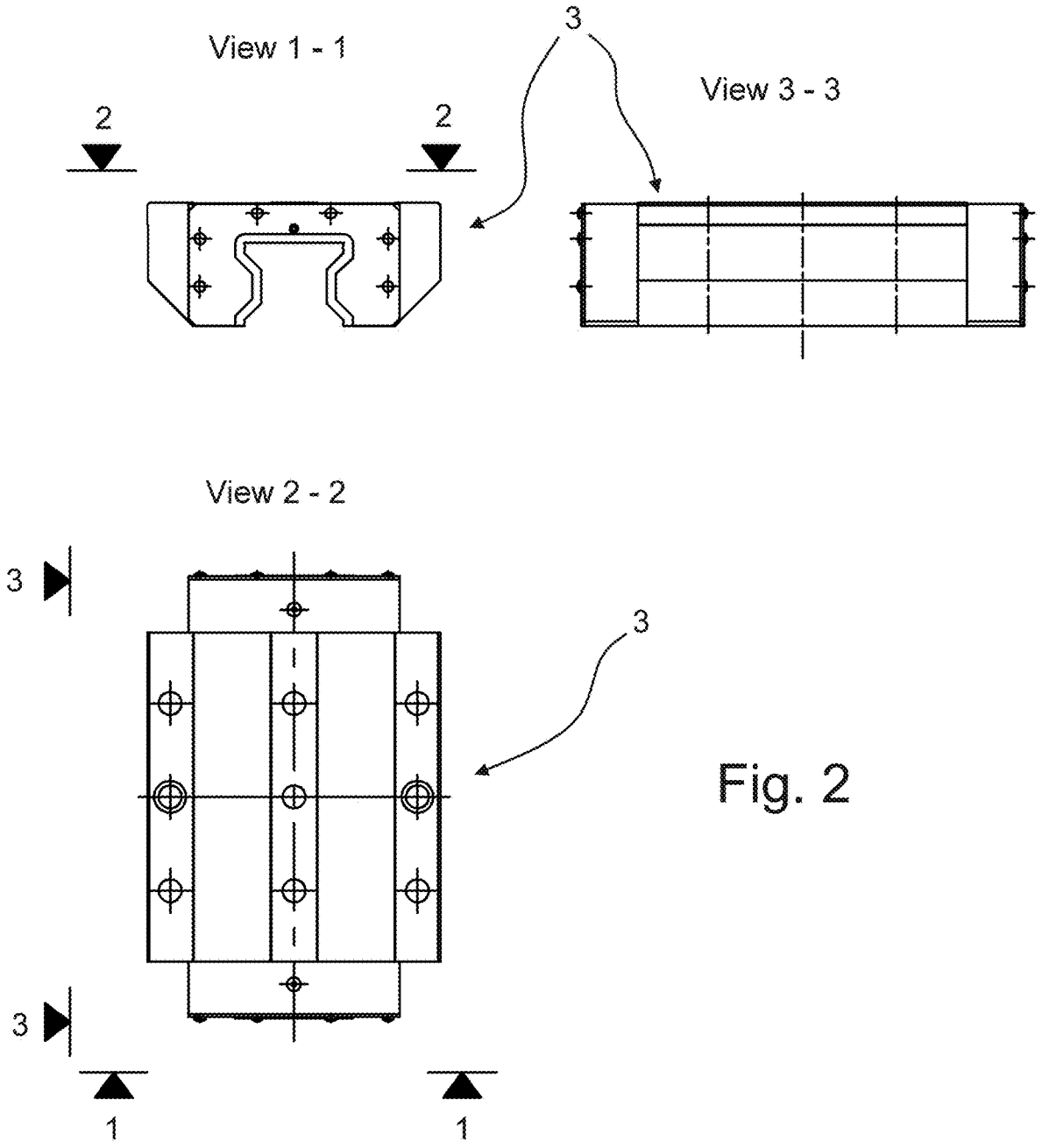
FIG. 2 shows a heavy-duty roller carriage.

FIG. 2 shows a carriage 3 in various views. There are several threaded holes (without reference numerals) on the upper side of the carriage 3 (see view 2-2). With the aid of these threaded holes, a load introduction plate 15 (see FIG. 3) of the console 1 according to the invention is detachably connected to the carriage 3.

FIGS. 3 to 6 show the most important components of the first exemplary embodiment individually and in different views, such that their shape can be recognized in all details.

Figure 3:
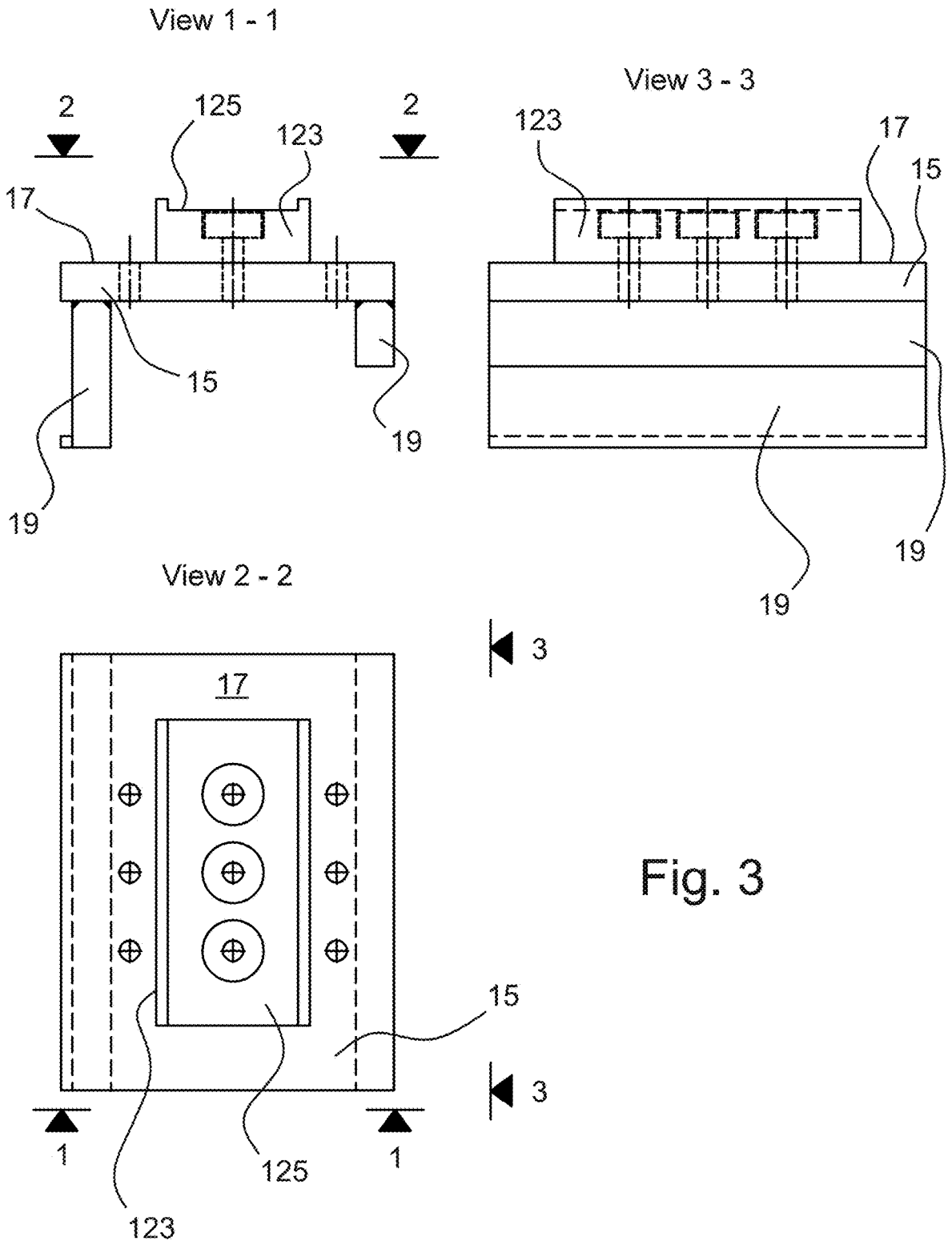
FIGS. 3 to 6 show the most important components of an exemplary embodiment.

FIG. 3 shows a load introduction plate 15. It is bolted to carriage 3. The load introduction plate 15 is part of a mechanical interface that connects a roof or a carrier 11 of a roof with a carriage 3 of the linear guide. In order to be able to absorb the forces introduced from the roof via the carrier(s) 11 into the console 1, several carriages 3 can be arranged one behind the other on the guide rail 5 and connected to the load introduction plate 15 with screws if necessary. This makes it easy to increase the load capacity of the linear guide. A further advantage is that the local load on the guide rail 5 does not increase despite the greater forces. The carriages 3, arranged one behind the other, transfer the vertical forces (Y-axis) and the horizontal forces (Z-axis) over a certain length (i.e. in the direction of the X-axis) to the guide rail 5. This reduces the local load on the guide rail 5 and a bearing structure 13 of the building.

The load introduction plate 15 comprises a base surface 17 and two side surfaces 19. The side surfaces 19 of the load introduction plate 15 extend parallel to the longitudinal direction (X-axis) of the guide rail 5. In the exemplary embodiment shown, the load introduction plate 15 has a U-shaped cross-section with its side surfaces 19. The load introduction plate 15 and the side surfaces 19 usually consist of three steel plates that are welded together.

A bearing block 123 is fastened to the upper side of the base surface 17 of the load introduction plate 15 (for example by welding or bolting). In the exemplary embodiment shown, it is bolted to the carriage 3 (see, for example, FIG. 7).

A recess 125 is provided on the upper side of the bearing block 123 in this exemplary embodiment. The recess 125 accommodates a first EPDM plate 127 (not shown in FIG. 3) in a form-fitting manner, such that the first EPDM plate 127 is secured against displacement in the direction of the Z-axis (i.e. transverse to the direction of travel of the carriage 3).

Figure 4:
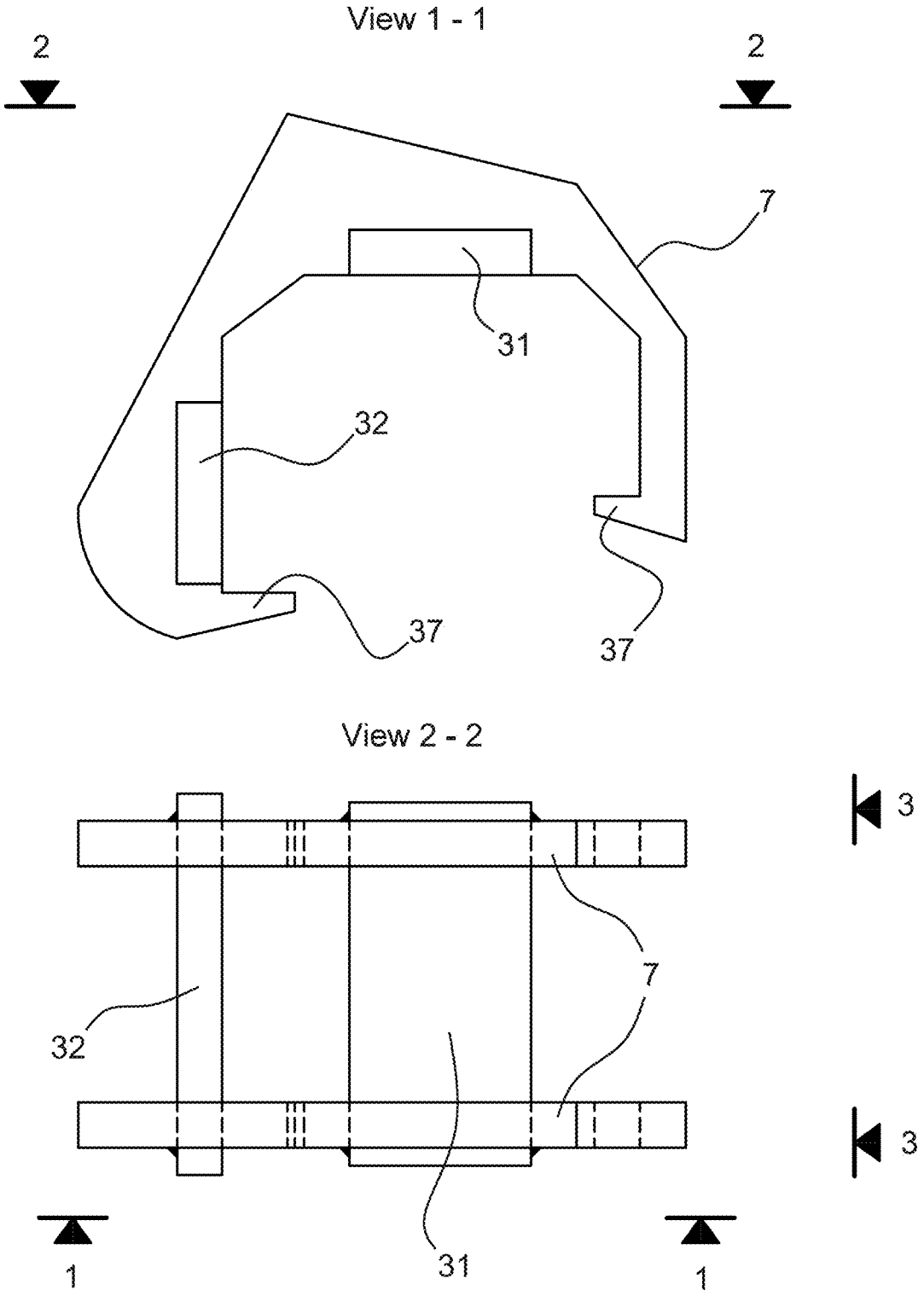

FIG. 4 shows another part of the mechanical interface between the linear guide and a carrier 11 of the mobile roof. This welded structure, referred to as the "upper part", comprises two ribs 7, an (optional) flange 9, which is not represented, and two bearing plates 31, 32.

Figure 7:
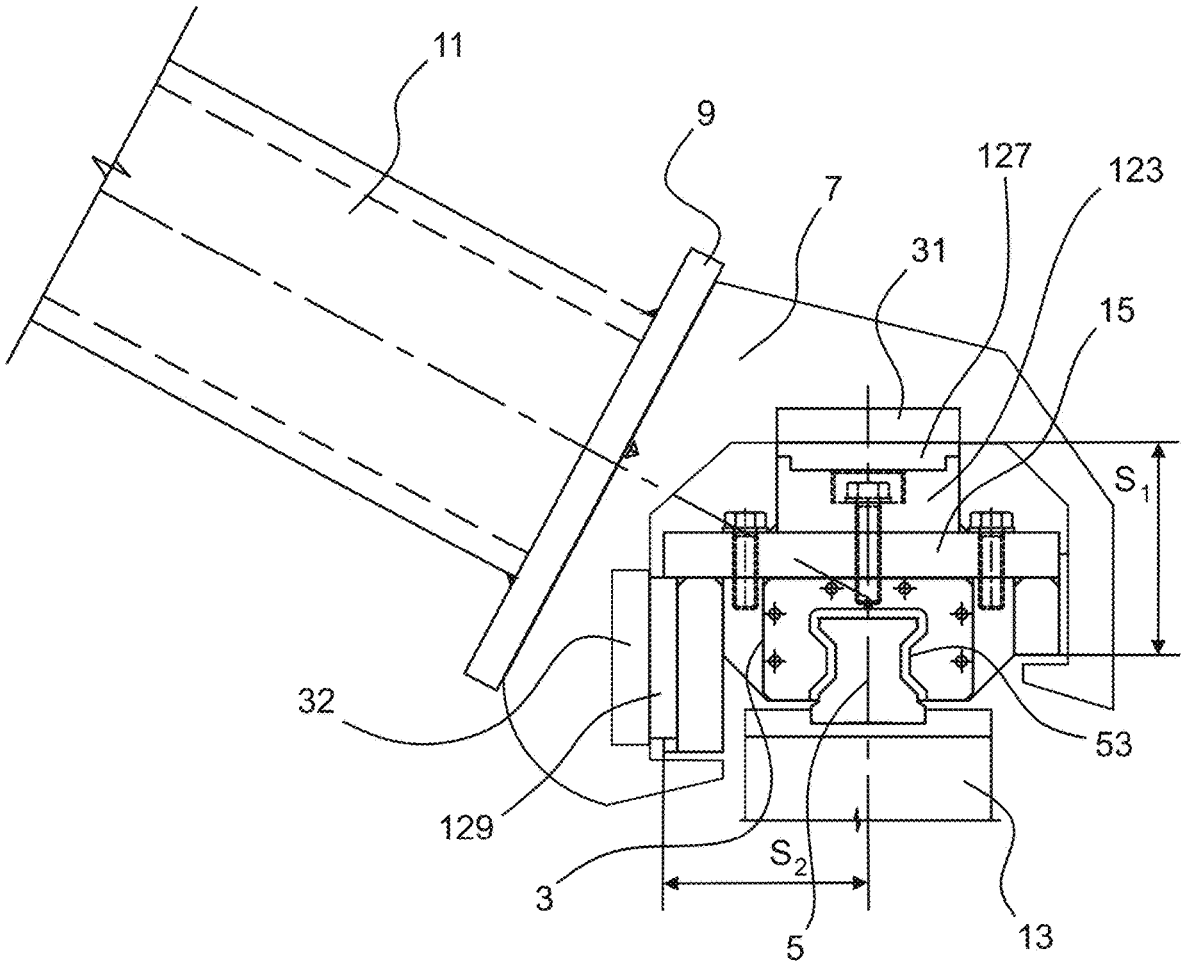
FIGS. 7 to 9 show the exemplary embodiment in the assembled state in various views.

A carrier 11 of the mobile roof is fastened to the ribs 7 or the flange 9 (not shown in FIG. 4) with fastening screws or by welding (see e.g. FIG. 7). The first bearing plate 31 and the second bearing plate 32 are welded to the ribs 7.

Holding parts 37 are designed at the lower ends of the ribs 7. The holding parts 37 protrude inwards and, in the assembled state of the console 1 (see FIG. 7), surround the load distribution plate 15 or its side surfaces 19. This results in a form closure connection between the carrier 11 and the carriage 3 of the linear guide. This form closure is for safety and prevents the roof from lifting off the linear guide (e.g. during a storm). The form closure has a certain amount of play; it is designed to allow and not hinder the relative movements between the roof and the building that occur during operation of the console 1.

Figure 5:
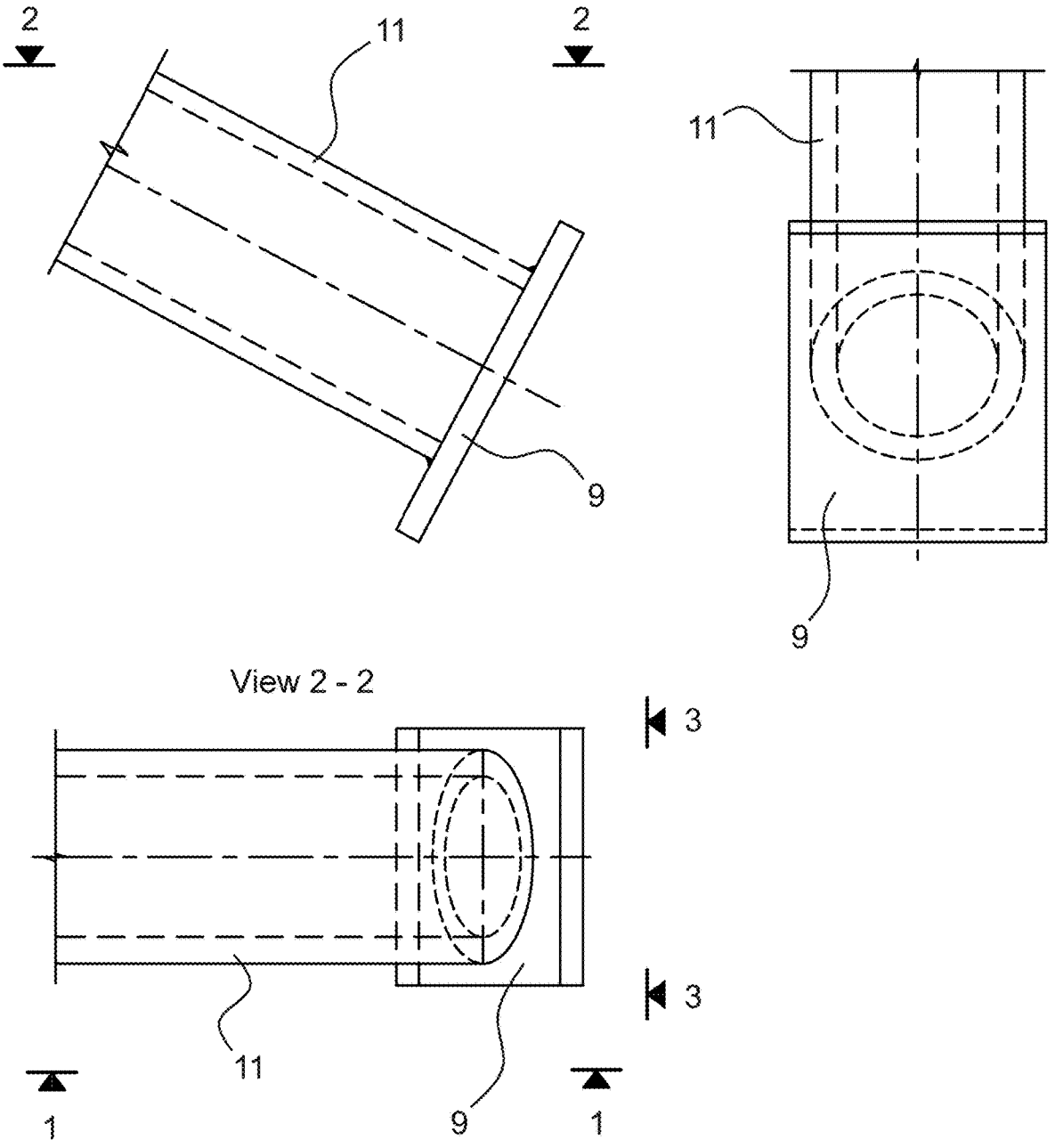

FIG. 5 shows a flange 9 and a carrier 11 of the mobile roof connected to it.

Figure 6:
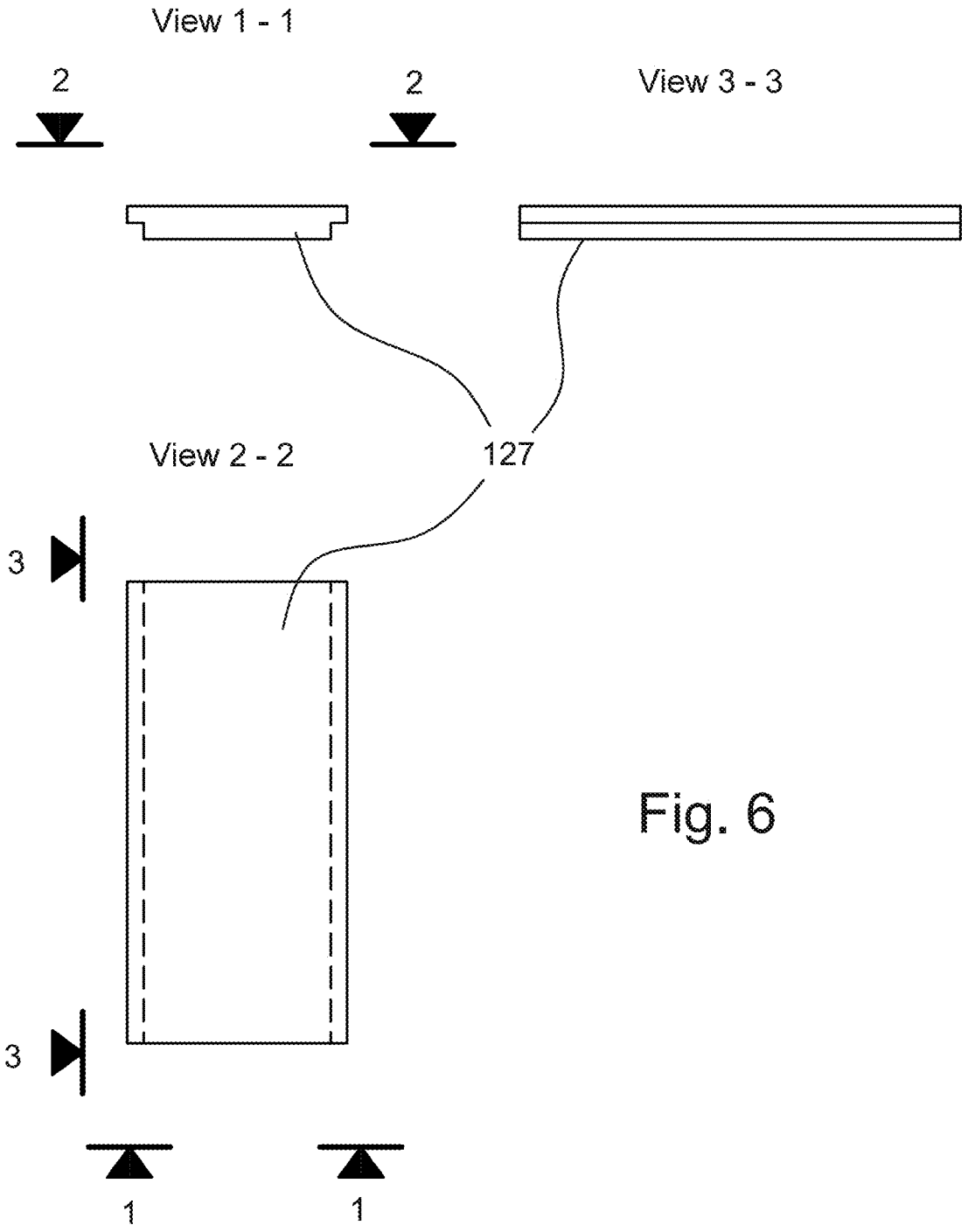

FIG. 6 shows a first PDM plate 127.

The first bearing plate 31 in the upper part (see FIG. 4) and the recess 125 in the bearing block 123 (see FIG. 3) of the load introduction plate are aligned parallel to one another, such that the first EPDM plate 127 can absorb the forces introduced into the first EPDM bearing by the bearing plate 31 over its entire surface and transmit them to the load introduction plate 15.

In this exemplary embodiment, the first bearing plate 31, the bearing block 123 and the first EPDM plate 127 form a first plain bearing. The first plain bearing transmits (vertical) loads in the direction of a Y-axis and thus orthogonal to the direction of movement (X-axis) of the carriage 3.

A second plain bearing layer is provided to transmit lateral loads (in the direction of a Z-axis). In this exemplary embodiment, it comprises the components second bearing plate 32, a side surface 19 of the load introduction plate 15 and a second EPDM plate 129 (see FIG. 7). The second plain bearing has a very similar design to the first plain bearing.

Figure 8:
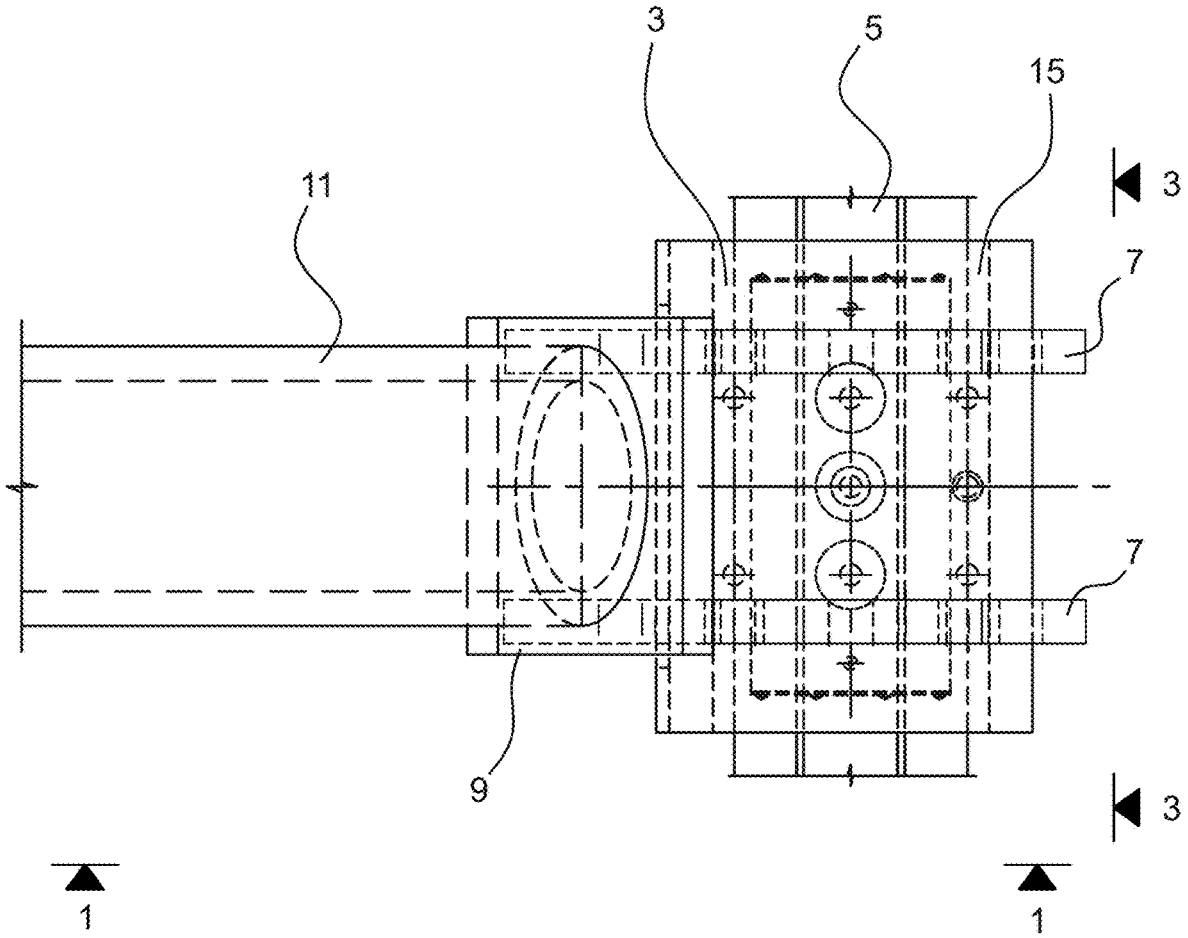
Figure 9:
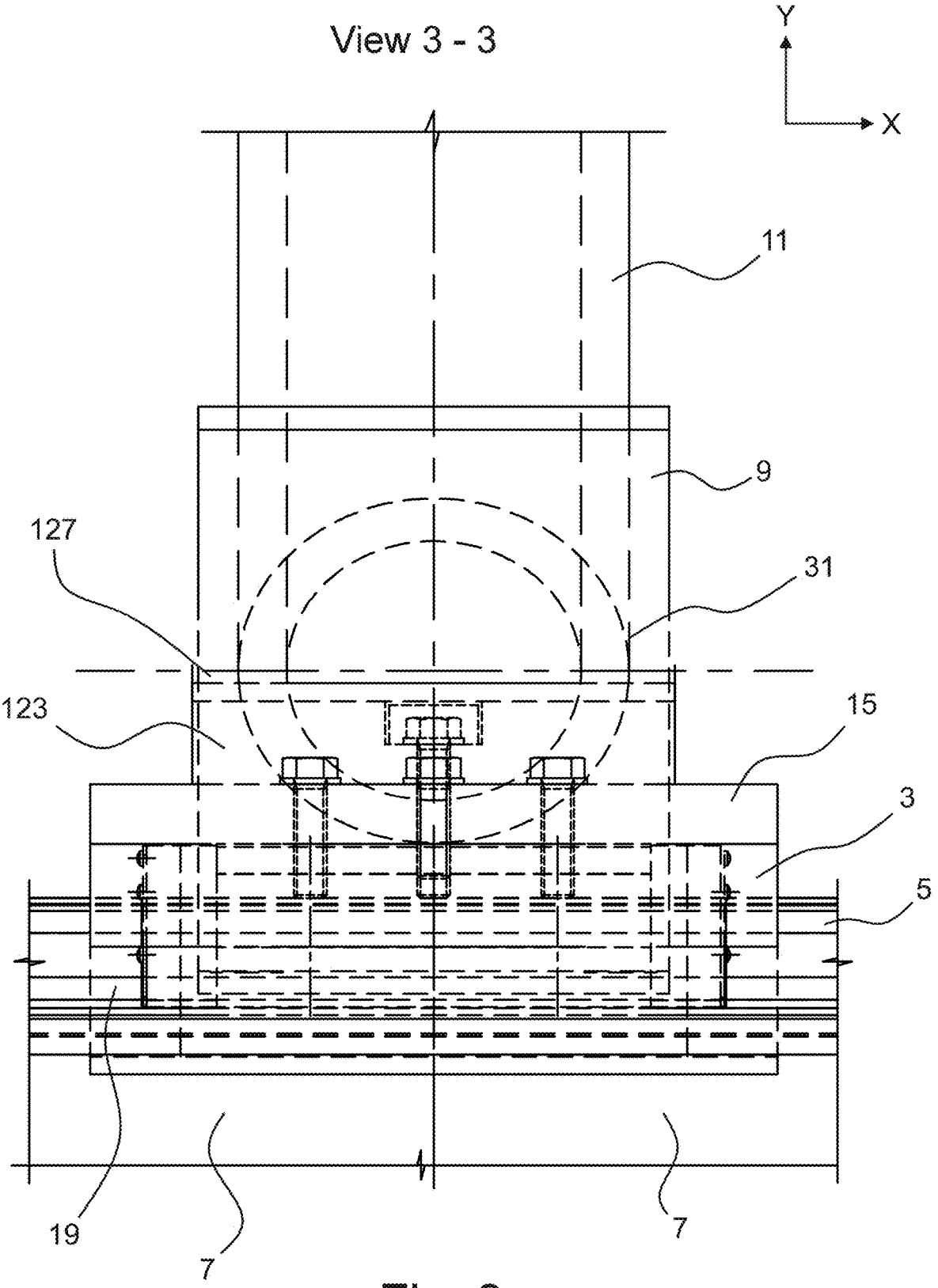

FIGS. 7, 8 and 9 show the first exemplary embodiment of a console 1 according to the invention in the assembled state in various views. The console 1 consists of the individual parts shown in FIGS. 1 to 6. The structure and function of console 1 become clear from the overview of FIGS. 1 to 9.

For reasons of clarity, not all reference numerals are shown in FIGS. 7 to 9.

FIG. 7 shows a front view of the console 1 as it may be used in an application for moving a roof. The console 1 is assembled on one or more carriages 3 of a linear guide. The carriage or carriages 3 are assembled on a guide rail 5 in a form-closed manner and are retractable in the direction of an X-axis. Carriage 3 and guide rail 5 form the linear guide.

A roof or a carrier 11 of a roof is connected to the linear guide via a mechanical interface, which comprises two ribs 7, a first bearing plate 31, a second bearing plate 32 and a load introduction plate 15 in the exemplary embodiment shown.

The guide rail 5 is in turn connected to a bearing structure 13 of a building or similar. Details of the connection (screw connection, clamping, etc.) of guide rail 5 and bearing structure 13 are not represented in FIGS. 7 to 9. The bearing structure 13 can be a steel carrier, a concreted ring beam or something similar.

The figures show only a small part of the retractable roof and a console 1 together with its connection to the bearing structure 13 of the building. Of course, the roof is not only fastened on one side to the console 1 shown, but there is a second console (not shown) to the left of the console 1 shown in FIG. 7, which is "laterally reversed" but otherwise of the same design. As a rule, at least four consoles 1 (one at each corner) are provided on a movable component (roof or facade). For large components, there may also be six, eight or more consoles 1. For reasons of clarity, however, only one console 1 is represented.

As in the exemplary embodiment shown, the linear guide can be a linear guide with roller bearings available on the market. Such linear guides are used in machine tools, for example. The advantage of using linear guides from the mechanical engineering sector is that components manufactured and tested to a very high quality are available. In addition, the appropriate model can be selected from the linear guide manufacturer's catalog according to the loads that occur.

The guide rails 5 are usually composed of several parts arranged one behind the other. Carriage 3 is only recognizable in its outer contour or cross-section. The rolling bodies between carriage 3 and the "waisted" guide rail 5 are also not shown in the figures, as the person skilled in art is therefore familiar with positive-locking linear guides mounted on roller bearings.

In order to be able to absorb the forces introduced from the roof via the carrier(s) 11 into the console 1, several carriages 3 can be arranged one behind the other on the guide rail 5 if necessary and connected to the load introduction plate 15 by screws. This makes it easy to scale the load capacity of the linear guide.

A further advantage of this scalability is that the local load on the guide rail 5 does not increase despite greater forces. The carriages 3, which are arranged one behind the other, transfer the forces acting in the direction of the Y-axis and the Z-axis over a certain length (i.e. in the direction of the X-axis) to the guide rail 5. This reduces the local load on the guide rail 5 and a bearing structure 13 of the building.

The interaction of the first and second EPDM bearing ensures that vertical and lateral loads are transmitted safely from the carrier 11 to the carriage(s) 3; nevertheless, due to the "softness" of the EPDM plates 127 and 129, minor angular errors can be flexibly compensated.

The angular errors can be caused by the unavoidable tolerances when building a large roof, and/or by locally different thermal expansions on the structure, for example if part of the structure is exposed to sunlight and another part of the structure is in the shade.

LIST OF REFERENCE NUMBERS

1 console
3 carriage
5 guide rail
7 rib,
9 flange
11 carrier of the roof/facade
13 bearing structure
15 load introduction plate
17 base surface
19 side surface
21 extensions
25 fastening screw
27 bolts
31 first bearing plate
32 second bearing plate
35 legs
37 holding part
39 contact surface
53 storage area
55 base
123 bearing block
125 recess
127 first bearing plate made of elastomer, EPDM or another material
129 second bearing plate made of elastomer, EPDM or another material
$S_1$ first distance
$S_2$ second distance

What is claimed is:

1. A console for retractable roofs and facades comprising a load introduction plate, a mechanical interface and two elastomer bearings, wherein the load introduction plate has a base surface and at least one side surface, wherein the mechanical interface comprises at least one rib, a first bearing plate arranged on the at least one rib and a second bearing plate arranged on the at least one rib, characterized in that a first elastomer bearing is arranged between the base surface of the load introduction plate and the first bearing plate, and in that a second elastomer bearing is arranged between the second bearing plate and the side surface of the load introduction plate.

2. The console according to claim 1, characterized in that the load introduction plate has two side surfaces, wherein an angle between the base surface and the side surfaces lies in an area between 60° and 120°.

3. The console according to claim 1, characterized in that the first elastomer bearing is designed as a first elastomer plate and the second elastomer bearing is designed as a second elastomer plate, in that a bearing block is mounted on the load introduction plate and receives and/or carries the first elastomer.

4. The console according to claim 1, characterized in that the at least one rib positively engages around the load introduction plate and its side surfaces.

5. The console according to claim 1, characterized in that the mechanical interface comprises two or more ribs, and in that at least one of the first bearing plate and the second bearing plate is connected to the ribs.

6. The console according to claim 1, characterized in that each rib has two legs, in that at least one holding part is fastened to the legs, and in that the holding part or parts engages or engage around one of the side surfaces of the load introduction plate.

7. The console according to claim 1, characterized in that the load introduction plate is part of a linear guide, and in that the linear guide comprises one or more carriages and a guide rail.

8. The console according to claim 7, characterized in that the load introduction plate is detachably connected to the one or more carriages of the linear guide.

9. The console according to claim 7, characterized in that the guide rail has a base and a bearing area, and in that a first distance between the bearing area and a contact surface between the first bearing plate and the first elastomer bearing is the same as a second distance between the bearing area and the contact surface between the second bearing plate and the second elastomer bearing.

10. The console according to claim 9, characterized in that the difference between the first distance and the second distance is less than 30%.

* * * * *